US005278621A

United States Patent [19]

Okamoto et al.

[11] Patent Number: 5,278,621

[45] Date of Patent: Jan. 11, 1994

[54] SYSTEM FOR REMOVING FOREIGN MATTER ON PHOTOSENSITIVE BODY OR DEVELOPER CARRYING BODY IN IMAGE FORMING APPARATUS

[75] Inventors: Yoshikazu Okamoto; Junichi Hama, both of Kanagawa, Japan

[73] Assignee: Fuji Xerox Co., Ltd., Tokyo, Japan

[21] Appl. No.: 881,966

[22] Filed: May 12, 1992

[30] Foreign Application Priority Data

May 13, 1991 [JP] Japan ..... 3-107665

[51] Int. Cl.[5] ..... G03G 21/00

[52] U.S. Cl. ..... 355/305; 355/296

[58] Field of Search ..... 355/296, 301, 303, 305, 355/264, 269

[56] References Cited

U.S. PATENT DOCUMENTS 4,588,285 5/1986 Tagoku ..... 355/303 X
4,918,488 4/1990 Creveling et al. ..... 355/296

FOREIGN PATENT DOCUMENTS 57-20774 2/1982 Japan .
57-35885 2/1982 Japan .
63-8681 1/1988 Japan .
2-195363 8/1990 Japan .

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

A system for removing foreign matter on a photosensitive body or a developer carrying body in an image forming apparatus, in which a foreign matter removing unit 11 is arranged between a discharge lamp 7 and a transfer drum 9, the foreign matter removing unit 11 having a rotatable cylindrical electrode 11*a* that closely confronts a photosensitive body 2 at a predetermined distance. A high-voltage sinusoidal wave generator 12 whose frequency, dc component potential, and effective potential are variable is connected to the cylindrical electrode 11*a*. An ac electric field is generated between the cylindrical electrode 11*a* and the photosensitive body 2 by the high-voltage sinusoidal wave generator 12 and aggregates of toner particles whose size is larger than that of toner particles are resonated by the ac electric field. Application of a very weak dc electric field under this condition causes the aggregates of toner particles to move toward the cylindrical electrode 11*a*. As a result of the above construction, small foreign matter such as an aggregate of toner particles whose size is about 100 μm or a carrier adhering to the surface of the photosensitive body, or foreign matter contained in a developer on the developer carrying body can be removed surely without disturbing normal toner particles.

3 Claims, 1 Drawing Sheet

SYSTEM FOR REMOVING FOREIGN MATTER ON PHOTOSENSITIVE BODY OR DEVELOPER CARRYING BODY IN IMAGE FORMING APPARATUS

BACKGROUND OF THE INVENTION

The invention relates to a system for removing foreign matter adhering to the photosensitive body or the developer carrying body of an image forming apparatus, in which foreign matter such as an aggregate of particles adhering to the surface of the photosensitive body of the image forming apparatus is separated from toner particles forming a developed image before a transfer position or adsorbed by an electrode, or a carrier on the surface of the photosensitive body or foreign matter on the surface of the developer carrying body is similarly removed.

Foreign matter such as an aggregate of toner particles which is larger in size than a toner particle has often been found adhering to the surface of a photosensitive body while mixed with normal toner particles that form a developed image in conventional image forming apparatuses. If such large foreign matter is present on the surface of the photosensitive body, such large foreign matter acts so as to prevent a transfer sheet and the photosensitive body from coming in uniform contact with each other during transfer of a developed image.

For this reason, defective transfer occurs at and around the portion where the foreign matter is present, causing a so-called "transfer deletions" in an image transferred on the transfer sheet. In a full-color copying machine or the like, in particular, since four colors, which are black, magenta, cyan, and yellow, are transferred while overlapped one upon the other, even if the number of foreign substances adhering to the surface of the photosensitive body is small for a single color, four-folded transfer deletions are finally produced on the transfer sheet, thus largely affecting the image quality.

Moreover, in the color copying machine, only the slightest transfer deletions leads to noticeable color shading in the overlap-transferred image on the sheet, thus affecting the image quality to a greater extent than in the monochromatic copying machine.

Production of aggregates of toner particles within a developing unit or infiltration of foreign matter from outside to the developing unit, which are causes of transfer deletions, are hard to obviate completely and surely. To overcome this problem, a method of removing foreign matter such as aggregates of toner particles adhering to the surface of the photosensitive body before the transfer position has often been adopted conventionally.

Conventional methods of removing foreign matter are: e.g., (1) A method of removing foreign matter by suction while providing a duct in proximity to the surface of the photosensitive body and sucking the foreign matter utilizing sucking forces provided by the air flowing in the duct (Japanese Patent Unexamined Publication No. 195363/1990);

(2) A method of adsorbing foreign matter on an electrode utilizing coulomb forces while providing the electrode in proximity to the surface of the photosensitive body and applying a dc component to the electrode (Japanese Patent Unexamined Publication No. 8681/1988).

However, the conventional methods (1) and (2) of removing the foreign matter possess the following problems.

That is, method (1) not only entails comparatively large-scale equipment but also high cost. Further, in terms of performance, large foreign matter such as aggregates of toner particles whose sizes are up to about 500 μm can be sucked without accompanying normal toner particles that form a developed image on the surface of the photosensitive body, but if small foreign matter whose size is smaller than 500 μm are to be sucked together, stronger sucking forces are required, and this causes normal toner particles forming the developed image to be unpreferably sucked or disturbed. As a result, the image quality may be affected thereby.

According to various test results, even foreign matter whose size is about 100 μm affects the image quality. Thus, there is a limit in the performance of the method attempting to separate the foreign matter from the surface of the photosensitive body by the sucking forces of air.

Further, method (2) addresses the same problems as method (1). That is, if the electric field intensity is increased to adsorb the foreign matter whose size is about 100 μm onto the electrode by coulomb forces, the normal toner particles that form a developed image are adsorbed along with the foreign matter and disturbed, thus affecting the image quality in some cases.

SUMMARY OF THE INVENTION

The invention has been made in view of the above circumstances. Accordingly, an object of the invention is to provide a system for removing foreign matter from a photosensitive body or a developer carrying body in an image forming apparatus. That is, small foreign matter such as aggregates of toner particles and carriers whose sizes are about 100 μm and which adhere to the surface of the photosensitive body can be removed surely without adsorbing or disturbing normal toner particles that contribute to forming a developed image on the surface of the photosensitive body.

Another object of the invention is to provide a system for removing foreign matter from a photosensitive body or a developer carrying body in an image forming apparatus, which is capable of removing foreign matter such as aggregates of toner particles contained in a developer on a developer carrying body.

To achieve the above objects, the invention provides an electrode in proximity to the surface of a photosensitive body or a developer carrying body and applies a potential in which an ac component is superimposed on a dc component to the electrode. Selection of a proper value of frequency for the ac component allows only the foreign matter to be resonated by the difference in resonant frequency based on the difference in mass between the foreign matter and the normal toner particles on the photosensitive body or the developer carrying body. As a result of the resonance, the foreign matter becomes easy to be separated from the photosensitive body or the developer carrying body. Under this condition, application of a very small dc component causes the foreign matter to be moved toward the electrode by the coulomb forces. Accordingly, the foreign matter is removed from the surface of the photosensitive body or the developer carrying body.

In this case, conditions are set so that: an intersurface distance L between the electrode and the photosensitive body or the developer carrying body is within 0.1 mm≦L≦2 mm; and a frequency f of the ac component applied to the electrode is within 50 Hz≦f≦5 kHz; an effective potential $V_{RMS}$ of the ac component of the electrode is within 400 V/mm≦$V_{RMS}$/L≦1500 V/mm; a potential difference between the potential $V_e$ of the dc component on the electrode and a potential $V_p$ on the surface of the photosensitive body or the developer carrying body confronting the electrode is within 0 V/mm≦$|V_e - V_p|$/L≦1 kV/mm, so that an electric field generated by the potential difference between $V_e$ and $V_p$ acts so as to cause the foreign matter on the photosensitive body or the developer carrying body to move toward the electrode by the coulomb forces, and, as a result, even foreign matter whose size is about 100 μm can be removed readily without disturbing normal toner particles.

DETAILED DESCRIPTION OF THE PREFERRED EMBODIMENT

An embodiment of the invention will now be described with reference to the accompanying drawings.

Figure 1:
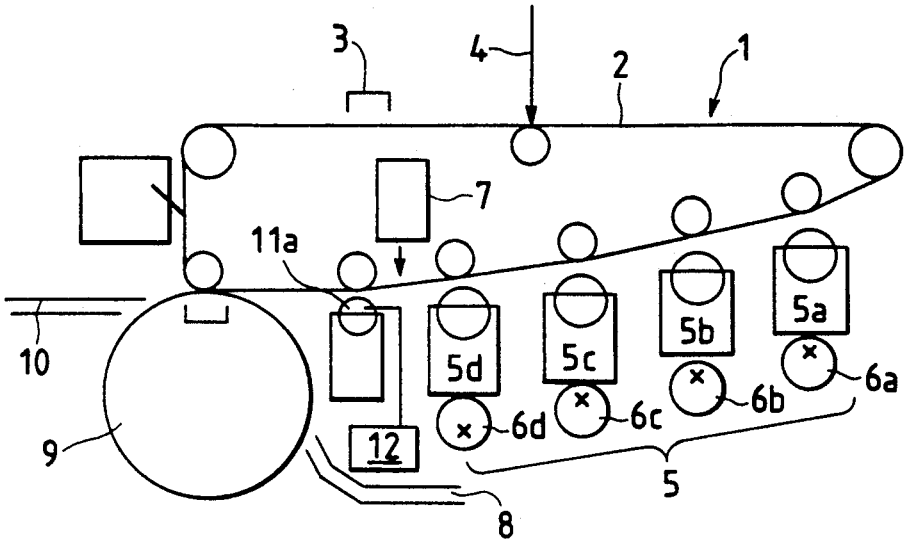
FIG. 1 is a diagram schematically showing an exemplary image forming apparatus used in a system of removing foreign matter on a photosensitive body or a developer carrying body in an image forming apparatus, which is an embodiment of the invention.

FIG. 1 is a diagram schematically showing an exemplary image forming apparatus used in a system for removing foreign matter on a photosensitive body of an image forming apparatus, which is an embodiment of the invention.

As shown in FIG. 1, a photosensitive body 2 of an image forming apparatus 1 used in this embodiment is made up of a belt-like organic photosensitive body and is rotatable clockwise as viewed from FIG. 1. The photosensitive body 2 is charged by a charger 3 and is subjected to exposure 4 thereafter. The exposure 4 allows a latent electrostatic image to be formed on the surface of the photosensitive body 2.

The photosensitive body 2 on which the latent electrostatic image has been thus formed is designed to move toward a developing device 5. The developing device 5 is made up of a yellow developing unit 5*a*, a magenta developing unit 5*b*, a cyan developing unit 5*c*, and a black developing unit 5*d* from right to left as viewed from FIG. 1, and these developing units are movable up and down by eccentric cams 6*a*, 6*b*, 6*c*, 6*d*, respectively. And the respective developing units near the photosensitive body sequentially, and develop the moving latent electrostatic image on the photosensitive body 2 in yellow, magenta, cyan, and black in the written order (in FIG. 1, the black developing unit 5*d* is found at the position nearest to the photosensitive body 2 and thus is developing the latent electrostatic image).

Upon end of developing, the photosensitive body 2 is irradiated by a discharge lamp 7 to cause the potential on its surface to near 0 V, and is advanced to a transfer section. In the meantime, a transfer sheet is supplied from a sheet guide 8, is wrapped around a transfer drum 9, and is rotated counterclockwise together with the transfer drum 9. The toner developed on the photosensitive drum 2 during the rotation is transferred on the sheet repetitively to complete the transfer in four colors, and then the transfer sheet is separated from the transfer drum 9. The transfer sheet is then introduced into a sheet guide 10 and forwarded to a fixing section.

Further, a foreign matter removing unit 11 is provided between the discharge lamp 7 and the transfer drum 9 in this embodiment. The foreign matter removing unit 11 has a rotatable cylindrical electrode 11*a*, and this cylindrical electrode 11*a* is arranged so as to closely confront the photosensitive body 2 at a predetermined distance. A high voltage sinusoidal wave generator 12 capable of varying its frequency, dc component potential, and effective potential is connected to the cylindrical electrode 11*a*.

The high voltage sinusoidal wave generator 12 generates an ac electric field between the cylindrical electrode 11*a* and the photosensitive body 2, and it is the ac electric field that produces a condition under which an aggregate of toner particles whose diameter is larger than that of a toner particle is easy to be separated from the photosensitive body 2 by resonance. The generation of a very weak dc electric field by applying an almost 0 V dc component to the cylindrical electrode 11*a* under this condition causes the aggregates of toner particles to move toward the cylindrical electrode 11*a*. The aggregates of toner particles which have adhered to the cylindrical electrode 11*a* are scraped off by a brush, a scraper, or the like.

By the way, there is a mass ratio of about 1 to 1000 between a normal toner particle and an aggregate of toner particles whose size is about 100 μm, and such a ratio can be translated into a ratio of about 1 to $1000^{\frac{1}{2}}$ in terms of resonance frequency. Therefore, while the normal toner particles do not resonate, the aggregates of toner particles having a large mass, even those whose size is in the order of 100 μm, can be removed by selecting an appropriate frequency without disturbing normal toner particles. Experiments have been made to actually verify that aggregates of toner particles which have adhered from the developing device 5 on the surface of the photosensitive body 2 during developing are removed and adsorbed by the cylindrical electrode 11*a* of the foreign matter removing unit 11 and that the normal toner particles remain unseparated from the surface of the photosensitive body when the aggregates of toner particles are removed.

The following conditions have been set for the experiments. The photosensitive body 2 was negatively charged by the charger 3 and the developer was positively charged, so that a portion on the photosensitive body 2 which has not been exposed by a laser could be developed. In this case, a binary-component developer consisting of toner and carrier was used as the developer; the average size of a toner particle was 11 μm; and the carrier, which had an average size of 50 μm and was prepared by coating ferrite-containing particles with acrylic and a teflon-containing organic material, was used. Further, those produced naturally at the developing device 5 and those produced artificially and added to the developing device 5 were used as the aggregates of toner particles. In this case, the size of an aggregate of toner particles was set to within 50 to 200 μm. Still further, the distance between the photosensitive body 2 and the cylindrical electrode 11*a* was set to 0.5 mm. Separation of the normal toner particles was judged by the deposition of the toner on the cylindrical electrode 11*a*.

The results of the experiments were as follows. (1) As a result of the experiments in which only the dc component potential was varied with no application of ac component, the effect of removing the aggregates of toner particles was not observed at all at a positive potential. When the polarity of the potential was reversed, a remarkable removing effect was exhibited at about −500 V. However, the normal toner particles were also removed along with the aggregates, and deposition of the toner on the cylindrical electrode 11*a* was observed.

(2) Then, the experiments were conducted with the dc component potential set to 0 V, the effective potential of an ac bias fixed to 500 V, and its frequency varied. As a result, a remarkable effect in removing the aggregates of toner particles was observed in the frequency range of from 50 Hz to 2 kHz. However, the effect was impaired with the frequency exceeding about 1 kHz, and the effect was drastically reduced with the frequency exceeding 2 kHz.

The normal toner particles were removed with the frequency becoming higher than 1 kHz, and deposition of the toner on the cylindrical electrode was observed. However, it was found that the normal toner particles were not removed at all at 500 Hz. That is, proven under these conditions was the ideal performance that a remarkable effect in removing the aggregates of toner particles was exhibited at frequencies from 50 to 500 Hz with not a single normal toner particle removed at all.

(3) Experiments were made to verify whether or not there is a range in which the effect of removing the aggregates of toner particles is remarkable with normal toner particles not removed at all, while setting the dc component potential to 0 V and varying the effective potential of the ac bias and its frequency. The results of the experiments are shown in FIG. 2.

Figure 2:
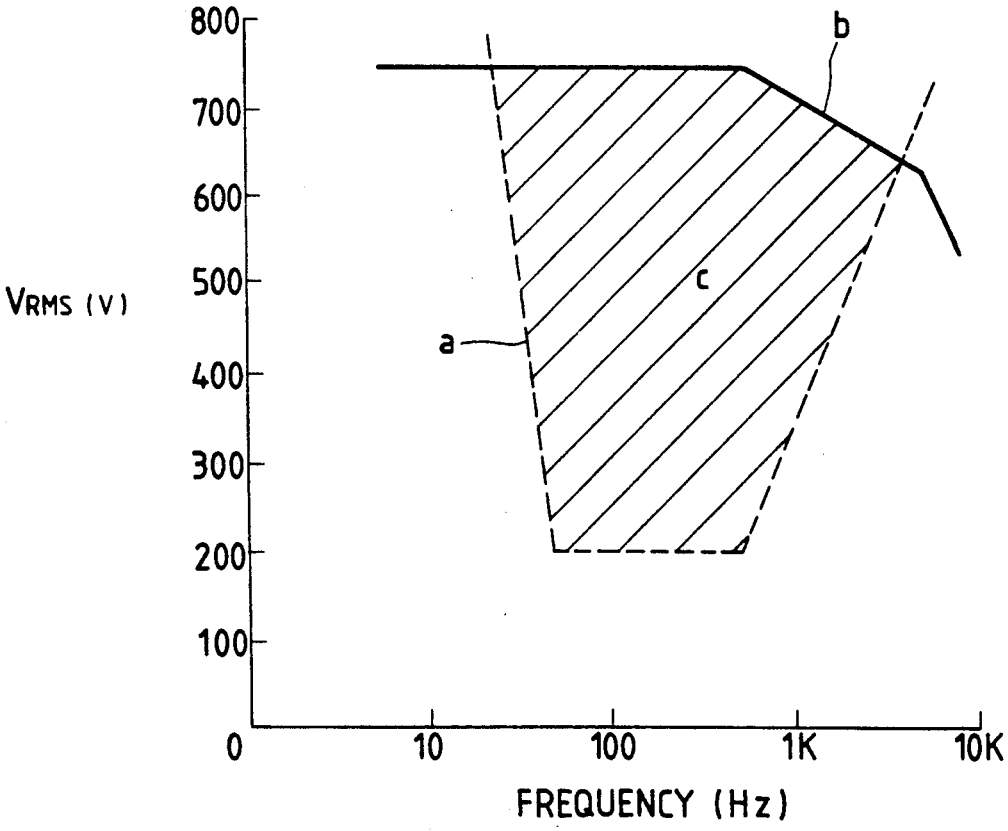
FIG. 2 is a diagram showing a relationship among the minimum value of an effective potential which makes the removing effect noticeable, the maximum value of an effective potential which does not permit normal toner particles to be removed, and the frequency.

In FIG. 2, a broken line a indicates the minimum value of the effective potential which makes the effect of removing the aggregates of toner particles noticeable, while a solid line b indicates them maximum value of the effective potential which surely prevents normal toner particles from being removed. As a result of these experiments, the effect of removing the normal toner particles was increased with increasing effective potential. It was verified that it was at 50 to 500 Hz and at an effective potential of about 200 to 750 V that the effect of removing the aggregates of toner particles was noticeable and that the normal toner particles were not removed at all.

It was observed that the maximum value of the effective potential which checks the normal toner particles from being removed decreased and the minimum value of the effective potential which makes the effect of removing the aggregates of toner particles noticeable increases with increasing frequency, but that there exists a range of effective potentials which makes the effect of removing the aggregates of toner particles remarkable and which prevents the normal toner particles from being removed at all up to about 5 kHz.

From the foregoing, a region c surrounded by the broken line a and the solid line b is a range within which the frequency and the effective potential can be selected so that the effect of removing the aggregates of toner particles is remarkable and normal of the normal toner particles can be surely checked.

While the case where foreign matter such as aggregates of toner particles adhering to the photosensitive body is removed has been described in the above embodiment, the invention may use a similar rotational cylindrical electrode and arrange a magnet in the cylindrical electrode, so that the invention is also applicable to a case where a carrier adhering to the photosensitive body is removed by a magnetic field.

The invention is further applicable to the case where foreign matter such as aggregates of toner particles contained in a developer on a developer carrying body is removed by arranging an electrode in proximity to the developer carrying body inside a developing unit.

Further, while the cylindrical electrode is used in the above embodiment, a rod-like electrode may also be used.

Still further, while the belt-like photosensitive body is used as a photosensitive body in the above embodiment, it goes without saying that the invention is also applicable to a case where a drum-type photosensitive body is used.

As is apparent from the foregoing description, the invention is featured by resonating only foreign matter by the ac component and causing the foreign matter to move toward the electrode by the dc component, thus allowing the foreign matter to be removed from the surface of the photosensitive body or the developer carrying body without fail.

Particularly, application of the ac component by properly selecting its frequency and effective potential allows even foreign matter whose size is 100 μm to be removed.

While the present invention has been described above with respect to preferred embodiments thereof, it should of course be understood that the present invention should not be limited only to these embodiments but various changes or modifications may be made without departure from the scope of the invention as defined by the appended claims.

What is claimed is:

1. A system for removing foreign matter on a photosensitive body or a developer carrying body in an image forming apparatus, comprising an electrode being arranged in proximity to a surface of said photosensitive body or said developer carrying body, said electrode for applying a potential being obtained by superimposing a dc component upon an ac component to said electrode, wherein an intersurface distance L between said electrode and said photosensitive body or said developer carrying body is within $0.1\ \text{mm} \leqq L \leqq 2\ \text{mm}$; a frequency of said ac component applied to said electrode is within $50\ \text{Hz} \leqq f \leqq 5\ \text{kHz}$; and effective potential $V_{RMS}$ of said ac component applied to said electrode is within $400\ \text{V/mm} \leqq V_{RMS}/L \leqq 1500\ \text{V/mm}$; a potential difference between a dc component potential $V_e$ at said electrode and a potential $V_p$ on said surface of said photosensitive body or said developer carrying body confronting said electrode is within $0\ \text{V/mm} \leqq |V_e - V_p|/L \leqq 1\ \text{kV/mm}$; so that an electric field generated by said potential difference between $V_e$ and $V_p$ acts so as to cause said foreign matter on said photosensitive body or said developer carrying body to move toward said electrode by coulomb forces.

2. A system for removing foreign matter on a photosensitive body or a developer carrying body in an image forming apparatus according to claim 1, wherein said electrode is a rotating body having a circular section.

3. A system for removing foreign matter on a photosensitive body or a developer carrying body in an image forming apparatus according to claim 1, wherein said electrode is a cylindrical rotating body and a magnet is firmly fixed inside said rotating body.

* * * * *